US007658287B2

(12) United States Patent
Hession

(10) Patent No.: US 7,658,287 B2
(45) Date of Patent: Feb. 9, 2010

(54) BLISTER AND PACKAGE SYSTEM

(75) Inventor: Christopher J. Hession, Knightdale, NC (US)

(73) Assignee: MeadWestvaco Corporation, Richmond, VA (US)

( * ) Notice: Subject to any disclaimer, the term of this patent is extended or adjusted under 35 U.S.C. 154(b) by 0 days.

(21) Appl. No.: 10/596,946

(22) PCT Filed: Jan. 7, 2005

(86) PCT No.: PCT/US2005/000644

§ 371 (c)(1),
(2), (4) Date: Apr. 20, 2007

(87) PCT Pub. No.: WO2005/068304

PCT Pub. Date: Jul. 28, 2005

(65) Prior Publication Data

US 2007/0272586 A1 Nov. 29, 2007

Related U.S. Application Data

(60) Provisional application No. 60/534,401, filed on Jan. 7, 2004.

(51) Int. Cl.
*B65D 85/00* (2006.01)

(52) U.S. Cl. ..... 206/528; 206/1.5

(58) Field of Classification Search ..... 206/531, 206/532, 534.1, 536, 538, 1.5, 528
See application file for complete search history.

(56) References Cited

U.S. PATENT DOCUMENTS 3,387,699 A 6/1968 Heller
4,120,400 A 10/1978 Kotyuk
4,192,422 A * 3/1980 Kotyuk ..... 206/528
4,817,819 A * 4/1989 Kelly ..... 221/2
5,019,125 A 5/1991 Rebne et al.
5,088,599 A * 2/1992 Mahler ..... 206/308.1

(Continued)

FOREIGN PATENT DOCUMENTS

DE 40 01 645 A1 8/1991

(Continued)

OTHER PUBLICATIONS

U.S. Appl. No. 11/969,100, filed Oct. 16, 2008, Gelardi, Joan A.

(Continued)

*Primary Examiner*—Jacob K Ackun, Jr.
(74) *Attorney, Agent, or Firm*—Alison R. Scheidler; Tsugihiko Suzuki

(57) ABSTRACT

A blister and package system (1) made of a blister card (3) and an outer package (5) with unique interacting locking mechanisms (23). The blister card is inserted in the outer package and locks immediately without having to further process the outer package or the blister card. The user is able to expose the blisters from the outer package by disengaging the lock. The blister card includes a formable, pliable sheet material (7), into which one or more individual cavities or blisters (9) are formed. The separated cavities are loaded with product (11) and sealed with one or more layers of puncturable or tearable sheet material, such as aluminum foil (13). The blister card contains a stop (21), which may be one or more additional cavities that form an interference mechanism, or an interference blister cavity. The interference blister is trapped by a locking mechanism and stopped by a catch flap (41) included in the outer package.

20 Claims, 11 Drawing Sheets

U.S. PATENT DOCUMENTS

| | | | | |
|---|---|---|---|---|
| 5,150,793 | A * | 9/1992 | Tannenbaum | 206/531 |
| 5,244,091 | A * | 9/1993 | Tannenbaum | 206/462 |
| 5,275,291 | A * | 1/1994 | Sledge | 206/531 |
| 6,047,829 | A * | 4/2000 | Johnstone et al. | 206/531 |
| 6,230,893 | B1 * | 5/2001 | Karow | 206/531 |
| 6,338,408 | B1 | 1/2002 | Anderson | |
| 6,349,831 | B1 | 2/2002 | Buss | |
| 6,460,693 | B1 * | 10/2002 | Harrold | 206/1.5 |
| 6,523,691 | B2 * | 2/2003 | Raj et al. | 206/538 |
| 6,640,693 | B2 | 11/2003 | Brezovnik et al. | |
| 6,641,031 | B2 * | 11/2003 | Evans et al. | 229/102 |
| 7,090,079 | B2 * | 8/2006 | Ehrlund | 206/531 |
| 7,325,689 | B2 * | 2/2008 | Buss | 206/532 |
| 2003/0062287 | A1 | 4/2003 | Gelardi et al. | |
| 2003/0102321 | A1 | 6/2003 | Maietta | |
| 2003/0209460 | A1 | 11/2003 | Bolnick et al. | |
| 2005/0183981 | A1 | 8/2005 | Gelardi | |

FOREIGN PATENT DOCUMENTS

| | | | |
|---|---|---|---|
| EP | 0547730 | A2 | 6/1993 |
| EP | 1 002 744 | A1 | 5/2000 |
| EP | 1277 670 | B1 | 5/2005 |
| GB | 1279941 | A | 6/1972 |
| JP | 2000 062843 | | 2/2000 |
| WO | WO 2004/037657 | A2 | 5/2004 |
| WO | WO 2005/030606 | A1 | 4/2005 |
| WO | WO 2005/068304 | A2 | 7/2005 |
| WO | WO 2007/101098 | A1 | 9/2007 |

OTHER PUBLICATIONS

U.S. Appl. No. 11/969,146, filed Oct. 23, 2008, Gelardi, John A.
U.S. Appl. No. 11/969,616, filed Jan. 4, 2008, Williams, Ricky.
U.S. Appl. No. 11/994,811, filed Jan. 4, 2008, Le, Thanhhung.

* cited by examiner

BLISTER AND PACKAGE SYSTEM

This application claims the benefit of U.S. Provisional Patent Application No. 60/534,401, filed Jan. 7, 2004 and U.S. Provisional Patent Application No. 60/570,494, filed May 13, 2004.

BACKGROUND OF THE INVENTION

There are many examples of packages with features meant to provide some level of child resistance to access to blister cards and products therein. Devices are particularly needed in the OTC and physician sample markets.

Examples include special peel-away backings on the blister, attaching the blister to some other carrier (such as Mead-Westvaco's SUREPAK product), sealing the blister between additional layers of material, or some combination of, these (such as MeadWestvaco's DOSEPAK product).

Needs exist for additional package for blister cards in a manner that provides some level of child resistance without preventing adults from gaining access to the blister cards and their contents.

Needs exist for improved methods of containing blister packs where the blister is easily accessible, but not readily separated from the outer package.

SUMMARY OF THE INVENTION

The present invention may be used for any products that are used singly or in small quantities at one time, for example, but not limited to, fasteners, needles and threads, foods and treats. This invention has two primary components, a blister card and an outer package. The blister card is similar to typical blisters available on the market and can be made from any materials known to the art for blister package. These materials normally include a pliable sheet material, usually plastic, into which one or more cavities are formed. The cavities are loaded with products and are sealed with one or more layers of sheet material, such as aluminum.

In one preferred form, the device is similar to those described later, but does not have any provisions for child resistance. The blister card slides into or is placed inside of an outer protective package, where both the blister card and outer package have interference mechanisms that prevent the blister card from being separated from the outer package. This feature may be used as an option in the child resistant package. The interaction of the outer package structure with the structure of the blister card is novel and unique, with or without the child resistant locking feature.

The blister card contains one or more additional cavities that form an interference mechanism or interference blister. The interference blister cavity does not hold product. A catch flap that is included in the outer package traps the blister cavity. The catch flap in the outer package abuts the interference blister, thus, preventing the blister card from being removed from the outer package. The interference blister is located at either end or both ends of the blister card. The blister card can be formed as one continuous, self-contained entity or can be assembled from a combination of several individual components, such as separate blisters, a one or two-piece carrier card and an interference blister.

The outer package is formed, folded or assembled from one or more pieces of material. The material or combination of materials used is of any type that meets the functional needs of the outer package, typically paper or plastic. The shape of the outer package would typically mimic that of the rectangular blister card, but could vary so long as there is still a slot into which the blister card is concealed. The outer package contains a catch flap that abuts against the interference blister, preventing the blister card from sliding out of the package. One package employs a catch flap at both ends of the outer package, and the blister card also has an interference blister at either end. That allows the user to pull the blister card out of the package from either end.

Both the blister card and the outer package have unique locking mechanisms that interact with each other. The blister card is inserted or placed in the outer package and locks immediately without having to add any further processing to the outer package or to the blister card. In one embodiment, exposing the blisters from a child resistant outer package requires disengaging the lock.

The blister card in the child resistant embodiment also contains a stop, which may be one or more additional cavities that form an interference mechanism, or an interference blister cavity. The interference blister cavity does not hold product. The interference blister is trapped by a locking mechanism and stopped by a catch flap included in the outer package. The locking mechanism in the outer package prevents the blister card from being exposed from the outer package unless a release mechanism is activated. The interference blister is located near one end of the blister card, typically the end that corresponds to the sealed end of the outer package. The interference blister is near a blister card's inner end, which is the trailing end of the blister card as it is being exposed from the outer package.

The child resistant outer package can be formed, folded, or assembled from one or more pieces of material. The material or combination of materials used can be of any type that meets the functional needs of the outer package. For example, a paperboard, box or a coated paper or plastic sleeve with a locking insert may satisfy the requirements. The shape of the outer package preferably mimics that of the blister card. The outer package shape can vary so long as there is a slot into which the blister card can be concealed. The outer package contains an internal member, the locking mechanism, that abuts the stop or interference blister, preventing the blister card from unintentionally sliding outward through the open end of the package. The user must activate a release mechanism in order to slide the blister card outward through the package. Preferably, an additional member, the catch flap, is extended inward from the open end of the outer package to engage the interference blister and to prevent the blister card from being separated from the outer package.

In preferred examples, one continuous blank of paperboard is cut, scored, folded and glued to create a rectangular package, mimicking the general shape of the blister card. The package contains a front panel, two side panels, a back panel, an elongated internal panel, a number of functional-locking panels, and closure panels at one end of the package. The elongated internal panel is approximately equal in dimension to the width of the front panel, but is not so long as to interfere with the folding scores.

The internal panel has an additional series of panels attached to the end closest to the package end closure flaps. The first panel is attached by a score and is folded 180-degrees, unprinted side-to-unprinted side and later is adhered to the internal panel by any means known. The adhered panel has another panel extended from it that is folded approximately 180-degrees, printed side-to-printed side, but is not adhered. This panel becomes the locking and release mechanism for the blister card in the package. The first adhered panel allows the locking panel to be positioned appropriately with respect to the stop or interference blister and controls the angle of the locking panel. The folding sequence and the memory in the paperboard provides the needed spring back for the locking and release mechanism. Different materials and structures may provide the new springing and locking.

The locking panel has an extension formed by a cut extending into the attached panel or has an aperture cut that extends through both the attached panel and the locking panel. This cut or aperture extends through the score between the locking panel and the attached panel. The interrupted score between the adhered panel and the locking panel on both sides of the extension acts as the pivot for the locking panel. The extension creates the lever for the release mechanism. When the lever is activated, the locking panel rotates about the score pivot point, and the locking panel is moved out of the way of the interference blister.

The internal panel also contains an aperture or one cut or a series of cuts that corresponds in location to the aperture or cuts on the locking panel. Likewise, the back panel contains an aperture or one cut or a series of cuts that correspond to those on the internal panel and the locking panel. The internal panel is folded 90-degrees to one side panel, and the back panel is folded 90-degrees to the other side panel. The back panel is adhered to the internal panel, such that the panels are aligned with each other and the apertures, cuts and scores are aligned with the locking mechanism. The aligned cuts and apertures allow the user to activate the lever/lock release mechanism when the package is formed.

Closure flaps are extended from end edges on the back and front panels or side panels.

Additional panels and features are extended from available raw edges or surfaces to create informational literature pockets, visual design features, and the like.

One panel feature that is added to the packages is a catch flap. The catch flap is attached to the internal panel near the open end of the package and extends into the package. The catch flap is long enough to ride on top of the blisters without getting caught on any of them, and yet the catch flap will still catch the interference blister. This prevents the user from separating the blister card and the outer package, thus increasing the likelihood that pushing the blister card back within the package following each use of the product will reactivate the child resistant feature.

The catch flap could also be made such that it would lie flat under the blister card, coinciding with the layered side of the blister card. With the flap in this orientation the interference blister would be designed such that the catch flap would extend up into the cavity of that blister.

Other examples include additional panels that can be used as fold over flaps for improved appearance, closure flaps, or tuck in flaps at the open end. A panel that is included for aesthetics purposes extends from the front panel and is folded inward 180-degrees unprinted side-to-unprinted side and adhered to an inside of the front panel. That effectively removes a raw edge, giving a more pleasing and finished look to the package.

A modified blister card has a fold-over paper card carrier aligned opposite apertures. One group of apertures on one side of the fold-over and card carrier receives blisters from a blister card. The opposite group of apertures on the other side of the carrier provides access to foil covering the back of each blister for tearing the foil and removing the product. The blister card carrier has a stop formed at one end spaced from the blister and foil openings.

In a preferred form, the stop is a large hollow blister with a flange that fits between the sides of the carrier. The large blister fits through a large hole on the first side of the carrier and is aligned with a second large hole on the other side of the carrier so that a releasable lock in the inner end of the outer package and a catch flap at the open end of the package may engage the large stop blister.

The carrier is folded over a conventional blister card, for example having twelve blisters in two rows of six, and slid into the outer package. The opposite sides of the carrier may be glued or may be held together by insertion in the outer package.

These and further and other objects and features of the invention are apparent in the disclosure, which includes the above and ongoing written specification, with the drawings.

DETAILED DESCRIPTION OF THE PREFERRED EMBODIMENTS

Figure 1:
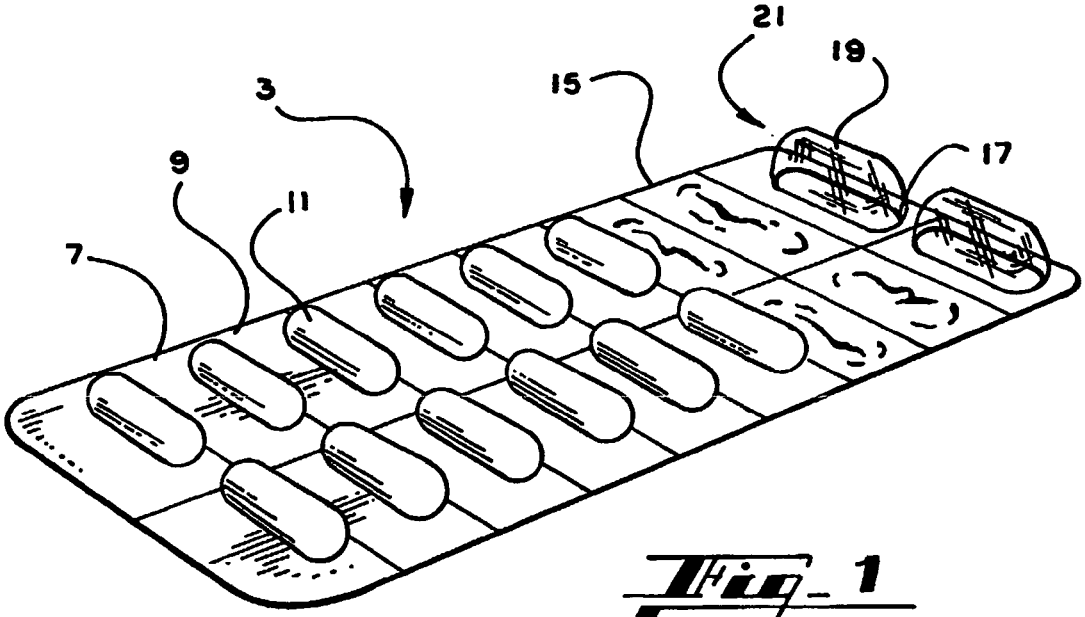
FIG. 1 shows a blister sheet ready for sliding into a package.

Referring to FIGS. 1-4, a blister package is generally indicated by the numeral 1. Two primary components are a blister card 3 and an outer package 5.

The blister card is similar to typical blisters available on the market and can be made from any materials known to the art for blister package. These materials normally include a pliable sheet material 7, usually plastic, in which one or more cavities or blisters 9 are formed. The cavities are loaded doses of products 11 and are sealed with one or more layers of sheet material, such as aluminum foil 13. The aluminum foil is punched, cut or tom to remove one capsule at a time.

The blister card 3 has blank spaces 15 without capsules and has near one end 17 one or more additional blister cavities 19 that form an interference blister 21. This interference blister cavity does not hold product; it is trapped by the locking mechanism included in the outer package 5. The locking mechanism in the outer package prevents the blister card from being slid outward from the outer package unless the release mechanism 25 is activated.

The interference blister 21 is located near one end 17 of the blister card 3 that corresponds to the sealed end 27 of the outer package 5.

The outer package 5 contains the internal locking mechanism 23 that abuts the interference blister 21, preventing the blister card 3 from sliding outward in the package 5. The user must activate a release mechanism 25 in order to slide the blister card 3 outward from the package 3. An additional catch flap member 41 extends from the open end 42 of the outer package 5 to prevent the blister card from being separated from the outer package.

Figures 2, 3, 4:
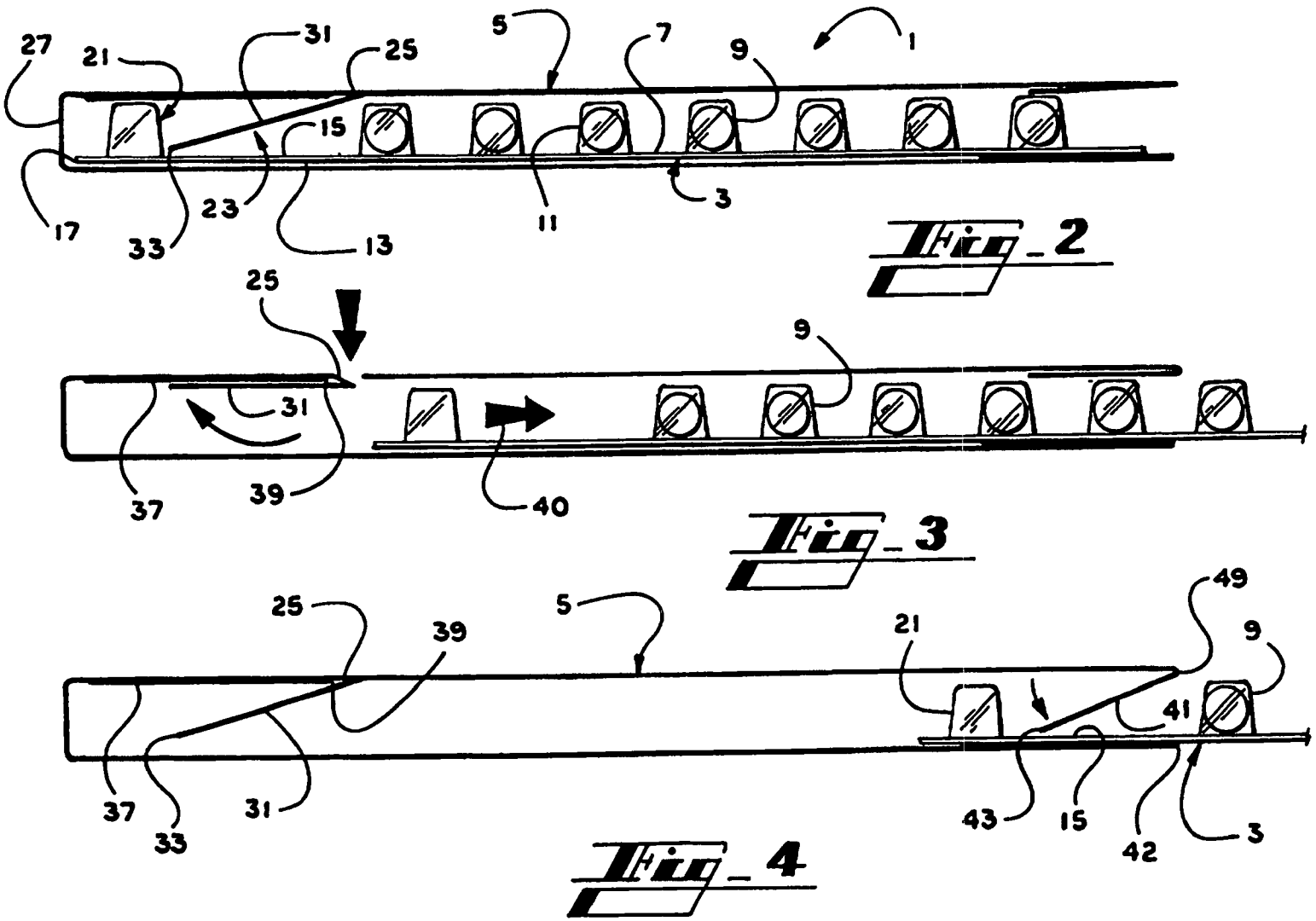
FIG. 2 is a cross-sectional view of the blister pack held in the package by a locking flap.
FIG. 3 shows the blister pack partially slide out of the package after pushing inward on a release lever to lift the locking flap.
FIG. 4 shows a catch flap in engagement with the locking blister.
Figure 5:
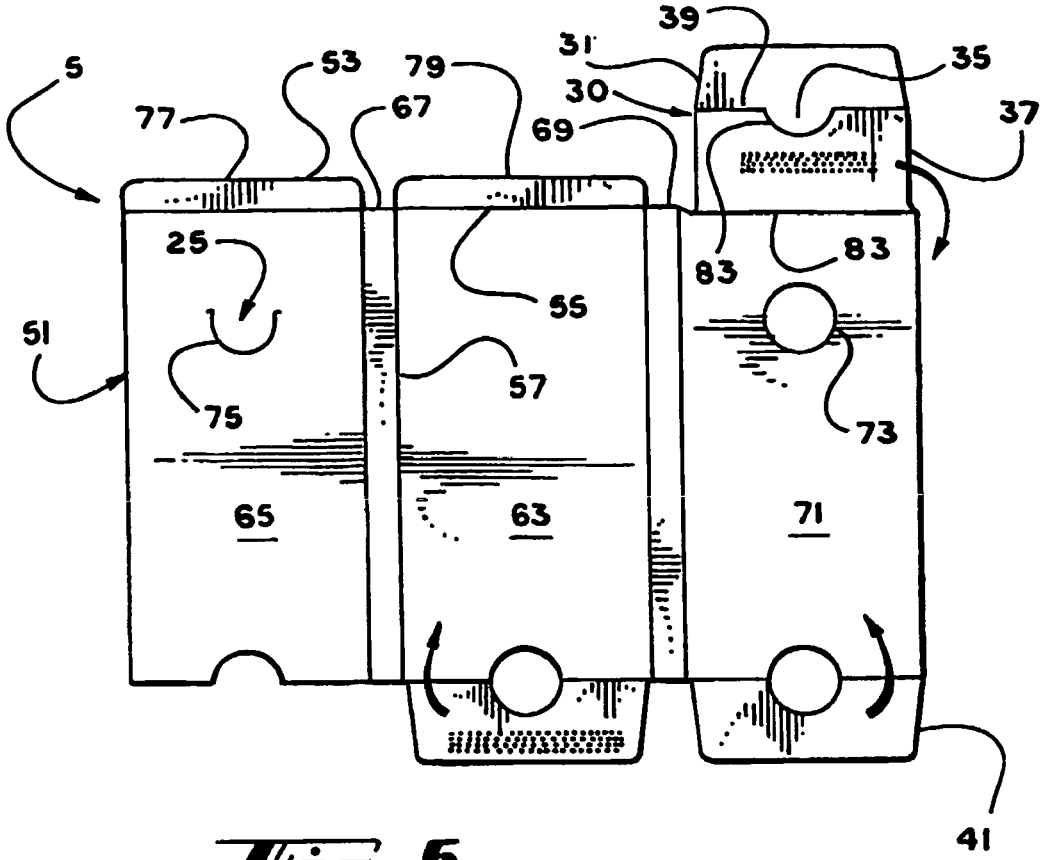
FIG. 5 shows a one-piece package blank.
Figure 6:
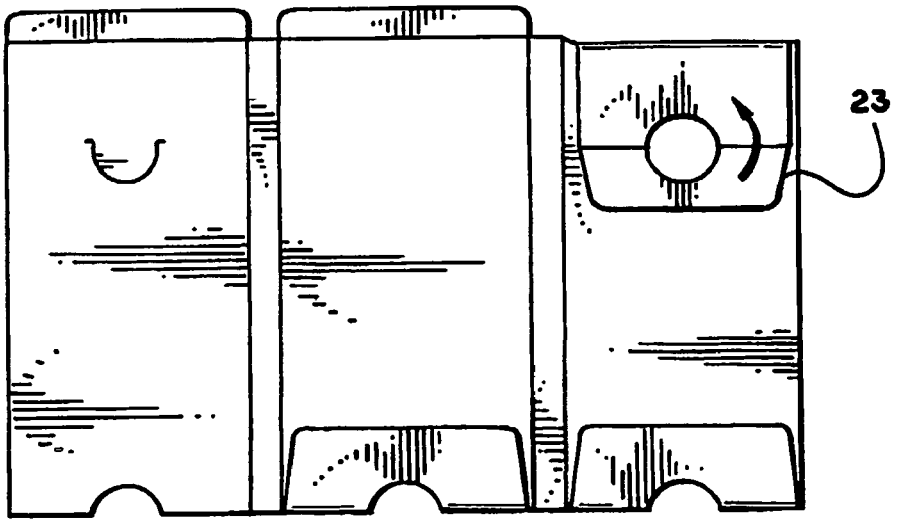
FIG. 6 shows the locking mechanism and catch flap folded inward 180-degrees on the inner panel.

As shown in FIGS. 2-4, the package 5 has a locking mechanism 23. A locking flap 31 has an end 33 that engages interference blister 21 and holds the blister pack 3 inside the package 5. An adhered panel 37 has a fold 39 which supports flap 31. The resilience of the adhered panel 37 and the locking flap 35 around the fold 39 holds the end 33 of the flap 31 downward until the locking flap is intentionally lifted.

FIG. 3 shows the lifting of the locking flap 31 and engaging 33 by pushing downward on the release mechanism 25 on the outer package. The release mechanism pushes downward on the lever 35, which is an extension of locking flap 31, rotating flap 31 around the resilient fold 39 and lifting the end 33 of the flap above the interference blister 21. That allows the blister pack 3 to be slid outward in the package in the direction 40.

As shown in FIG. 4, once the mechanism 25 is released the locking flap 31 springs downward by the memory resilience of the fold 39. A catch flap 41 at the open end 42 of outer package 5 has an end 43 that is held above the adjacent blister cavities 9, because the length of the flap 41 exceeds the spacing of the blister cavities. When the blank spaces 15 of the blister pack 3 reach the flap 41, the catch flap drops under the spring pressure of the fold 49 and the end 43 engages the interference blister 21, preventing complete removal of the blister pack 3 from the outer package 5.

After one capsule has been removed from the blister card by puncturing the foil covering the cavity in which that capsule is stored, the blister card 3 is pushed back into the package. The blisters 9 lift flaps 41 and 31 until flap 31 drops into place with the edge 33 adjacent the interference blister 21, returning the package to the condition shown in FIG. 2.

As shown in FIGS. 5-13, the outer package 5 can be formed, folded, or assembled from one piece 51 of a foldable, relatively rigid sheet material. The material (or combination of materials) used can be of any type that meets the functional needs of the outer package, preferably paperboard, and forms a slot 52 into which the blister card 3 can be concealed.

One continuous blank 51 of paperboard is cut 53, scored 55, and folded 57 to create a rectangular package 51 in the general shape of the blister card 3. The package 51 contains a front panel 63, a back panel 65, two side panels 67, 69, an elongated internal panel 71, functional-locking panels 30, 41, and closure panels 77, 79 at one end of the package. The elongated internal panel 71 is approximately equal in dimension to the width of the front panel 63, but is not so long as to interfere with the folding scores 55. Internal panel 71 has a series of panels 30 attached to the end closest to the closure flaps 77, 79. The first panel 37 is attached by a score 83 and is folded 180-degrees, unprinted side-to-unprinted side and later is adhered to the internal panel 71. This adhered panel 37 has locking panel flap 31 extended from it that is folded approximately 180-degrees, printed side-to-printed side, but is not adhered. This panel 31 becomes the locking and release mechanism 23 for the package. The first attached panel 37 allows the locking panel flap 31 to be positioned appropriately with respect to the interference blister 21 at the angle of the locking panel shown in FIG. 2. The folding sequence and the memory in the paperboard provide the needed spring back for the locking 23 and release 25 mechanisms. The locking panel flap 31 has a cut 83 extending into the attached panel 81. The cut 83 is located between the folds 39 that join the locking panel flap 31 to the attached panel 81.

When the panel 37 is adhered to the inside of inner panel 71, the folds 39 act as the pivot and create the lever 35 for the release mechanism 25. When the lever 35 is activated, the locking panel flap 31 rotates about the fold pivots 39 and is moved out of the way of the interference blister 21, as shown in FIG. 2. The internal panel 71 also contains an aperture 73 that corresponds in location to the lever 35 on the locking panel flap 31. Likewise, the back panel 65 contains a cut 75 that forms release lever 25 in a position that corresponds to the aperture 73 on the internal panel and the lever 35 on the locking panel flap 31.

Figure 7:
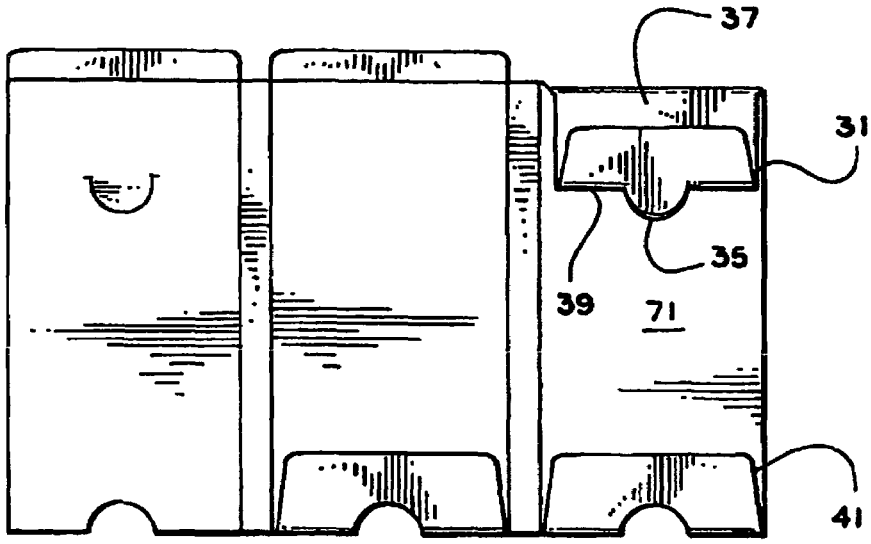
FIG. 7 shows the locking flap folded back 180-degrees with the lever extended before the adhered panel is secured to the inner panel.
Figure 8:
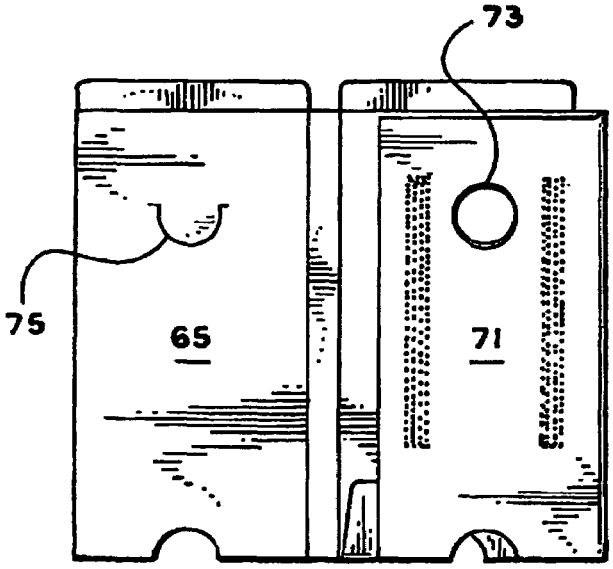
FIG. 8 shows the inner panel folded inward 180-degrees.
Figure 9:
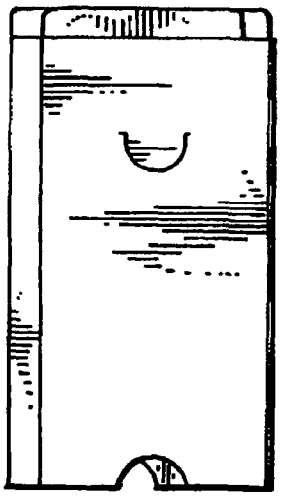
FIG. 9 shows one side panel and the back panel folded inward 180-degrees to align with and adhere to the inner panel.
Figure 10:
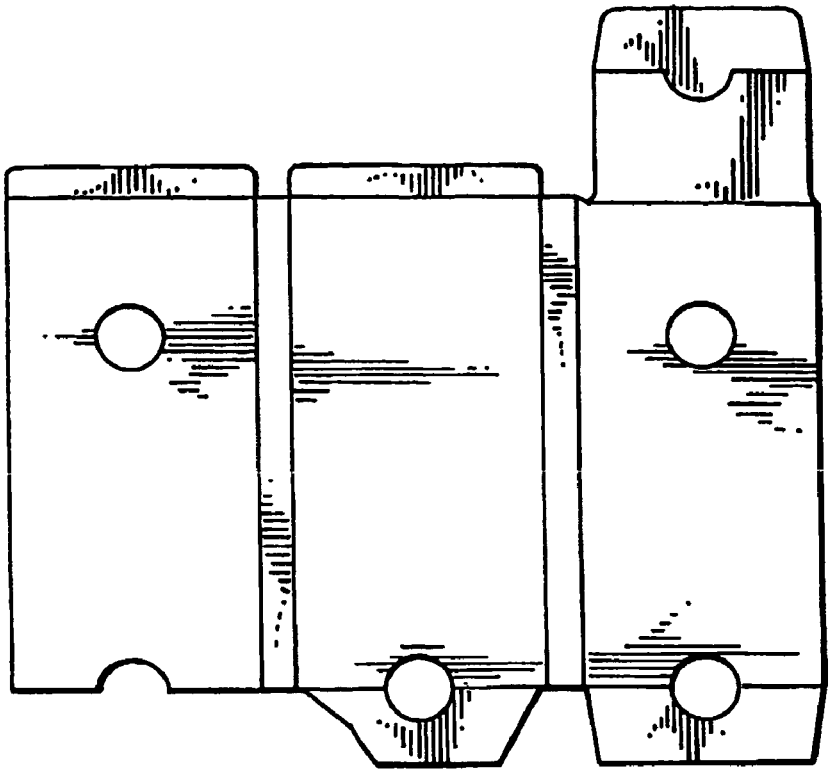
FIG. 10 shows another blank with an aesthetic panel for providing a smooth edge on the open end of the front panel.

As shown in FIGS. 7-9, in assembling the outer package, the locking panel 31 is bent around folds 39, which extends the lever 35. Then the adhered panel 37 is adhered to the inside of the internal panel. The internal panel 71 is folded 180-degrees, and then the back panel 63 is folded 180-degrees and adhered to the internal panel, such that the panels are aligned with each other, as shown in FIGS. 7 and 8, and the aperture cuts 73, 75 and folds 39 are aligned with the locking 23 and release mechanisms 25. These cuts and apertures allow the user to activate the lever/lock release mechanism when the package is formed.

Additional panel features are extended from available raw edges or surfaces to create closure flaps, informational literature pockets, visual design features, and the like. One panel feature that is added to the package is a catch flap 41.

As shown in FIGS. 5-10, the catch flap 41 is attached to the internal panel 71 near open end 42 of the package 5 and extends into the package. The catch flap 41 is long enough to ride on top of the blisters 9 without getting caught on any of them, as shown in FIGS. 2 and 3, and yet will still catch the interference blister 21, as shown in FIG. 4. That prevents the user from separating the blister card 3 and the outer package 5, thus increasing the likelihood that sliding the blister card 3 back into the outer package 5 following each use of the product will reactivate the child resistant feature.

Figure 11:
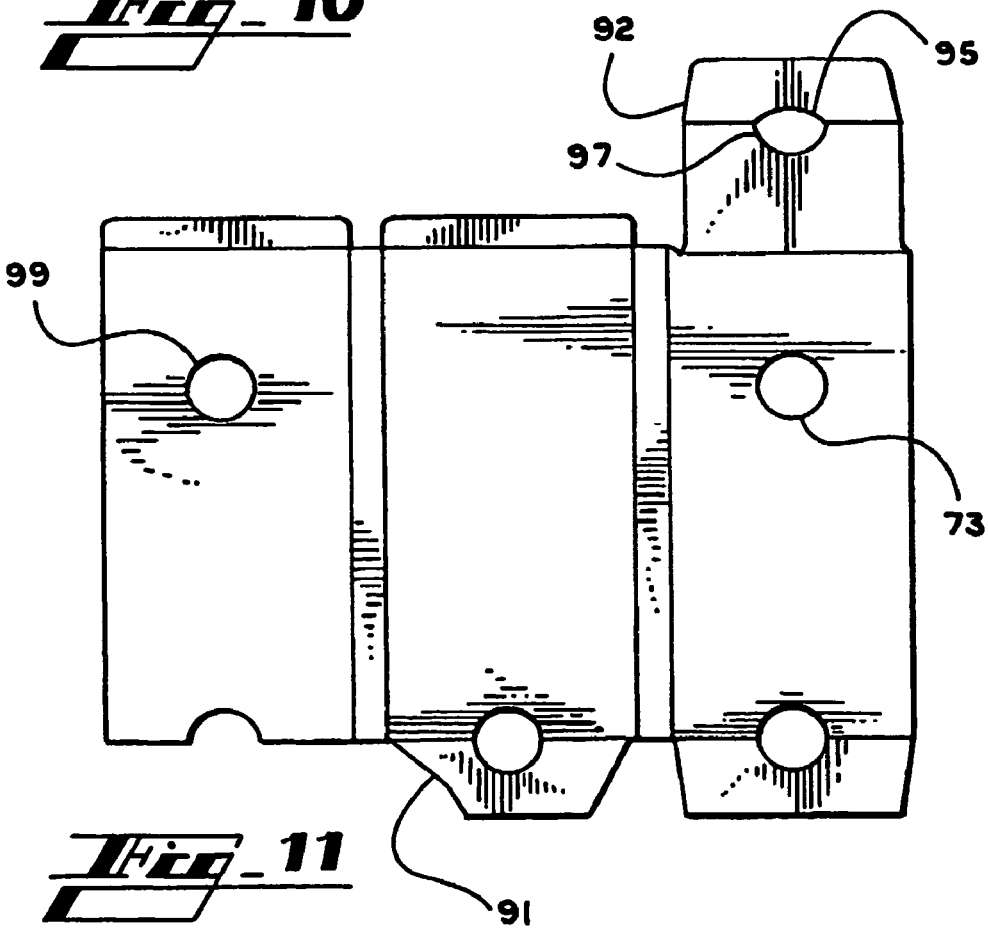
FIG. 11 shows a similar outer package blank with a pull-up lock release.

As shown in FIG. 11, a catch flap 91 is made such that it lies flat under the blister card 3, coinciding with the foil 13 layered side of the blister card. With the flap in this orientation the interference blister 21 is hollow and without a backing, such that the catch flap 91 extends up into the cavity of the blister 21.

FIG. 11 shows a modified locking panel flap 92 that has a finger hole 95 rather than a lever. To release the blister card for sliding in the package, a user inserts a finger through aligned holes 99, 73, 97 and 95 to lift locking panel flap 92 out of engagement with the interference blister 21 to release the blister card 3.

Other examples include additional panels that can be used as fold over flaps for improved appearance, closure flaps, or tuck in flaps.

Figure 12:
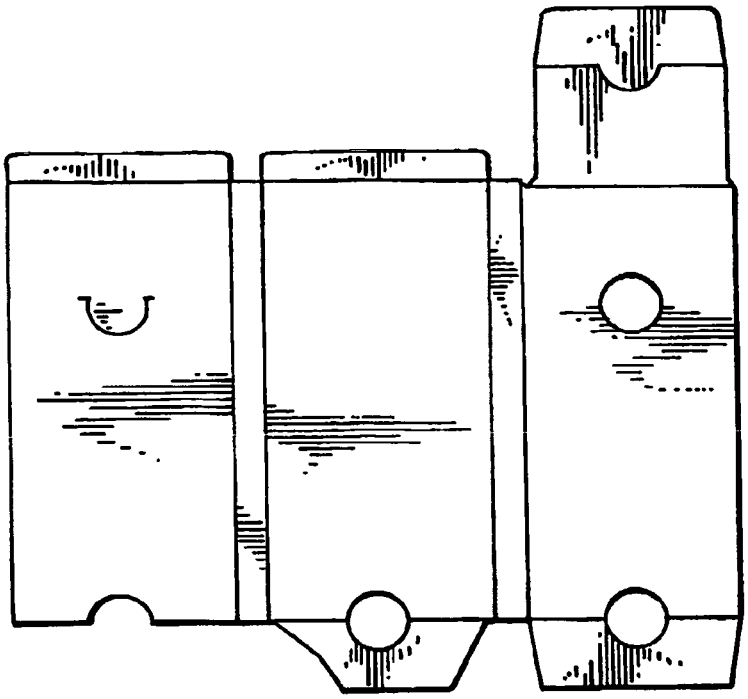
FIG. 12 shows a similar blank with a push down lock release and related apertures, cuts and scores.
Figure 13:
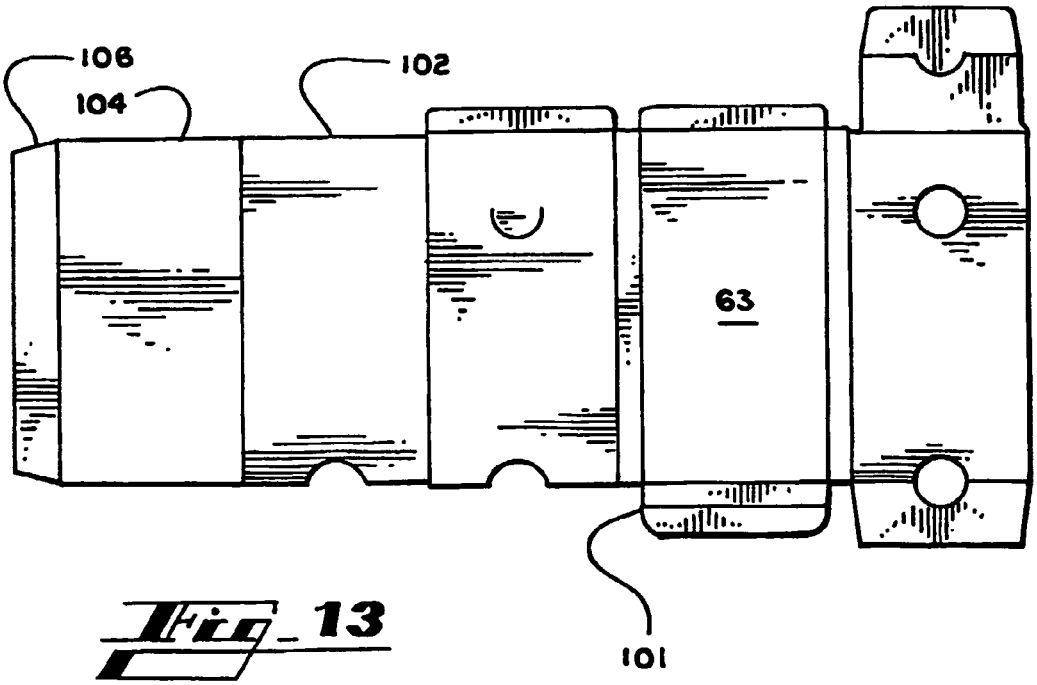
FIG. 13 shows a similar blank with a literature-receiving flap.
Figure 14:
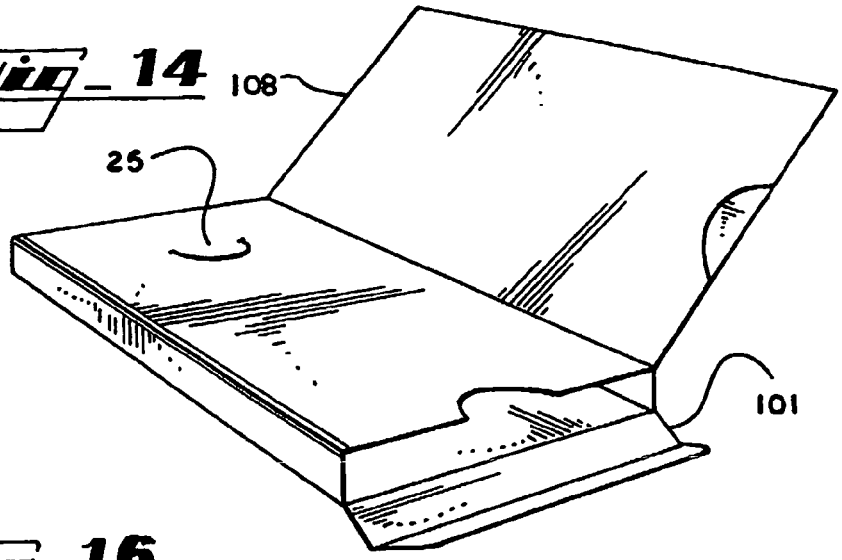
FIG. 14 shows a box with a literature-receiving flap.

Tuck-in flap 101 is shown connected to the open end 42 of front panel 63 in FIGS. 12 and 13. Also shown joined to back panel 65 are panels 102, 104 and glue panel 106 which become a literature slot flap 108.

FIGS. 5-10 illustrate a panel 62 that has been included for aesthetics purposes. This aesthetic panel extends from the open end 42 of the front panel 63 and is folded 180-degrees unprinted side-to-unprinted side and adhered to the inside of front panel 63. That effectively removes a raw edge, giving a more pleasing and finished look to the package.

Figure 15:
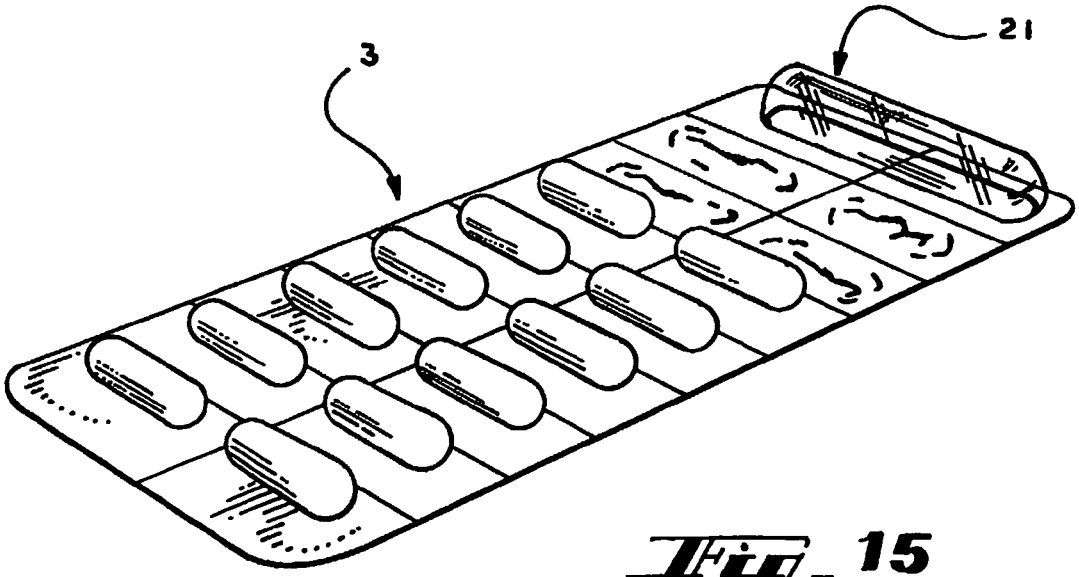
FIG. 15 shows the blister card with a hollow interference blister.

FIG. 15 shows a blister card 3 with hollow interference blisters 21 for engagement by a catch flap such as shown in FIG. 11.

Figure 16:
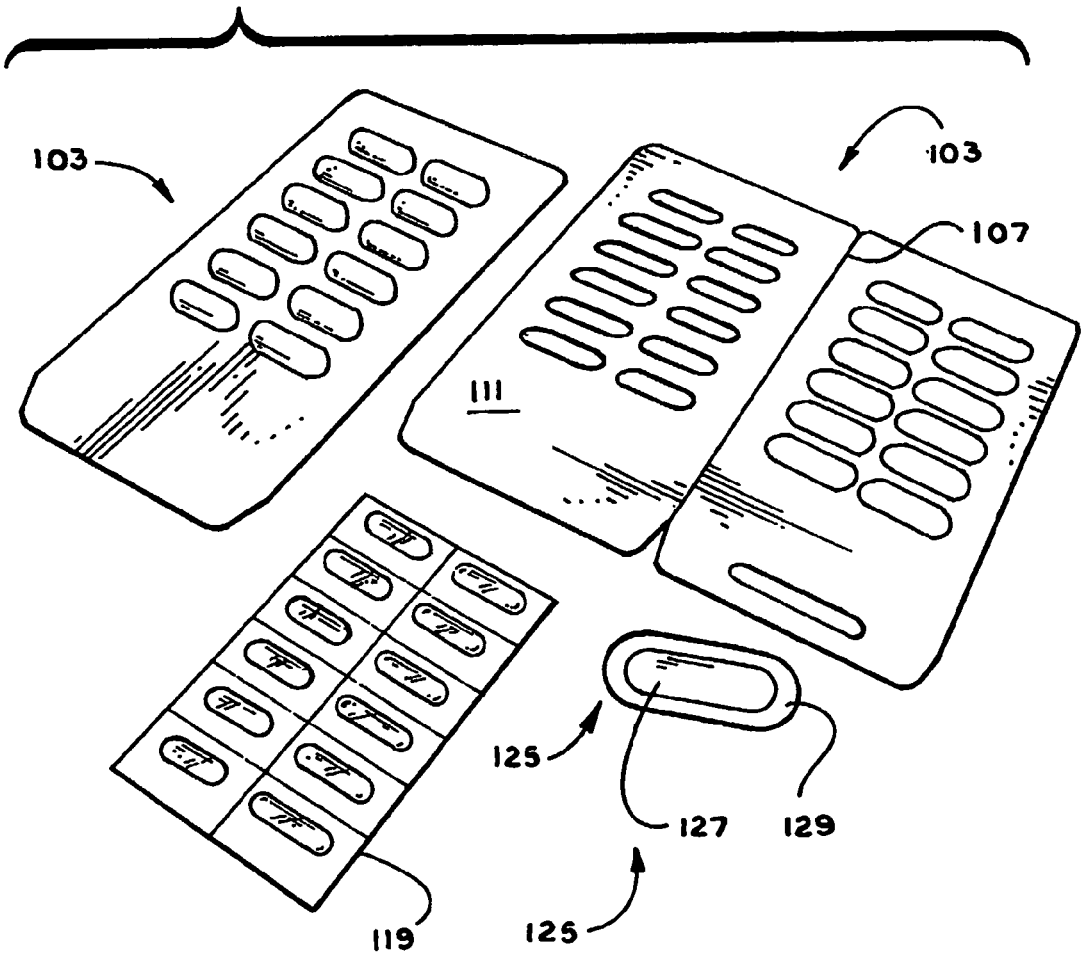
FIG. 16 shows components of an alternate blister card and carrier.

FIG. 16 shows an alternate blister card 103 formed from a large card 105 with a central fold 107 and opposite sides 109, 111 with similar cutouts 113, 115. Cutouts 113 on side 109 receive blisters 117 from standard twelve-dose blister card 119. Cutouts 115 provide access to the foil on the back of card 119 for piercing the foil to remove individual doses. A large opening 121 near an inner end 123 of side 109 receives a hollow upper portion 127 of a stop 125. A base 129 of stop 125 is secured between the sides 109 and 111 when they are joined together.

Figure 17:
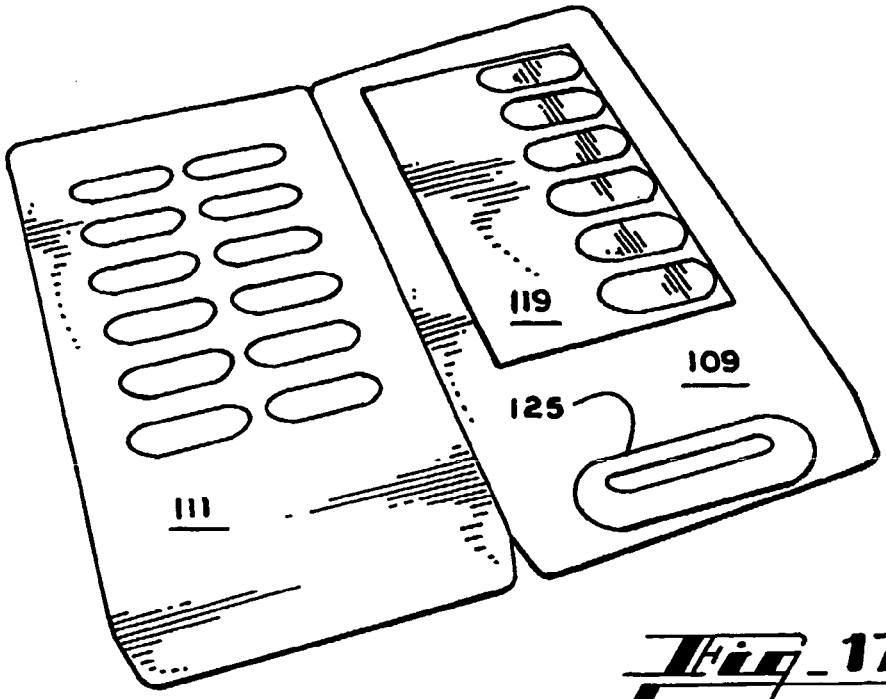
FIG. 17 shows an assembly of the alternate blister card carrier.

FIG. 17 shows the assembly of card 119 and stop 125 into apertures in side 109 of the blister card 103 before side 111 is folded over side 109. The sides may be glued with a strip of adhesive near the remote edges or held together by insertion in the outer package 5.

In an alternate form, an aperture may be provided in side 111 opposite the hollow portion 127 to allow use with a catch flap such as shown in FIG. 11.

Referring to FIGS. 18-24, the device is similar to those described previously, but does not have any provisions for child resistance. This invention is primarily for blister packed products. This invention has two primary components, a blister card and an outer package.

Figure 18:
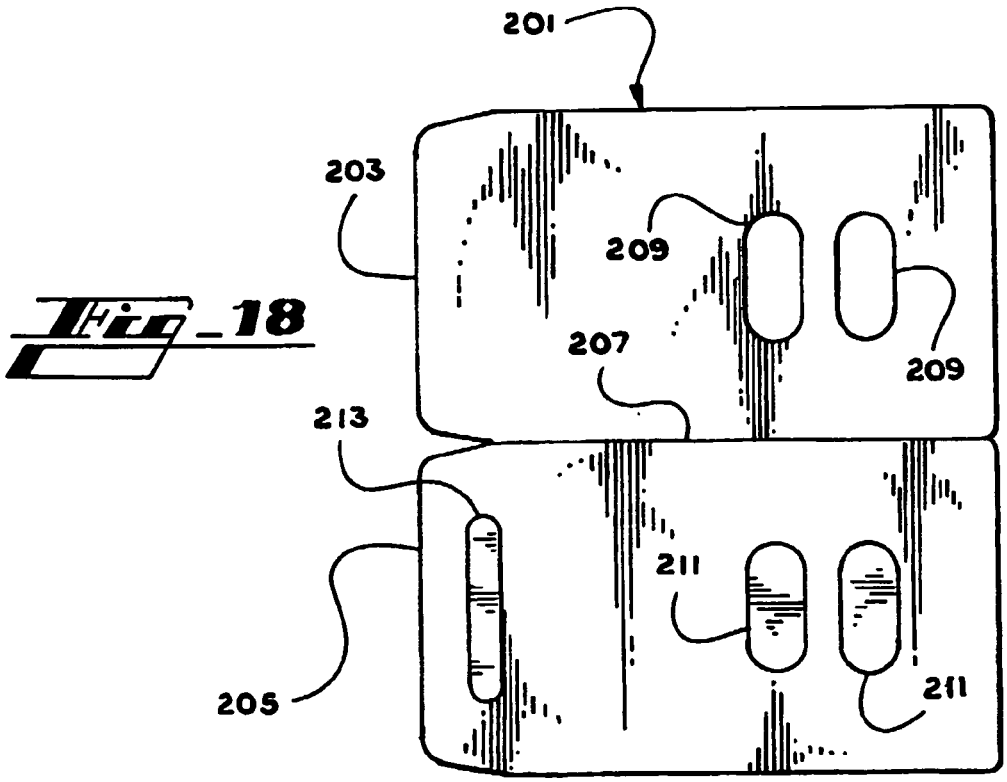
FIG. 18 shows a card for forming an assembled blister.

FIG. 18 shows a card 201 for forming an assembled blister. The card 201 has two halves 203, 205 connected by a hinge 207 that may be a score in the paperboard or a similar device. The first half 203 has openings 209 for passing the contents of a blister 211. One or more blisters are located in openings 211 in the second half 205.

Blisters inserted in the blister card 201 are similar to typical blisters available on the market and can be made from any materials known to the art for blister package. These materials normally include a pliable sheet material, usually plastic, into which one or more cavities are formed. The cavities are loaded with doses of product and are sealed with one or more layers of sheet material, such as aluminum foil. The blisters may be joined in a sheet or may be separate with flanges that are held between the card halves 203, 205 when glued and folded. The blister card 201 can be formed as one continuous, self-contained entity or can be assembled from a combination of several individual components, such as separate blisters, a one or two-piece carrier card and an interference blister.

The blister card 201 contains one or more additional cavities 213 that form an interference mechanism or hold an interference blister. The interference blister in cavity 213 does not hold products.

Figure 19:
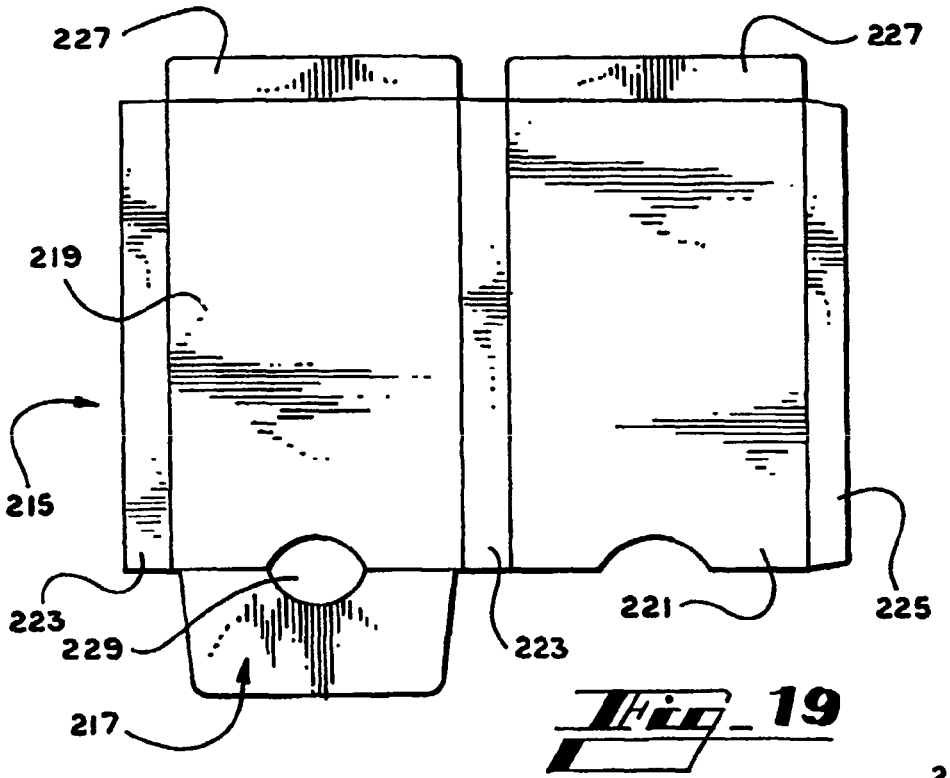
FIG. 19 shows a blank for forming a base package.

As shown in FIG. 19, a catch flap 217 is folded inward, but not glued, when forming an outer package from the outer package 215. Catch flap 217 traps the blister cavity 213. The catch flap 217 in the outer package 215 abuts the interference blister in opening 213 or engages opening 213 itself, preventing the blister card 201 from being removed from the outer package. The interference blister opening 213 is located at either end or both ends of the blister card 201. In the later case, catch flaps 217 are formed and folded inward at both ends of the outer package blank 215, and the ends of the outer package are left open. In both cases, the catch flap or flaps 217 are sufficiently long to rest upon the tops of the product holding blisters so as not to prevent their outward sliding.

FIG. 19 shows a blank 215 for forming a base package. The outer package 215 is cut, scored, folded and/or assembled from one or more pieces of material. In this embodiment, one continuous piece of paperboard is used. The material or combination of materials used is of any type that meets the functional needs of the outer package, typically paper or plastic. The shape of the outer package 215 would typically mimic that of the rectangular or other shaped blister card 201, but could vary as long as there is still a slot into which the blister card is concealed. The outer package contains a catch flap 217 that abuts against the interference blister in opening 213 or against opening 213, preventing the blister card 201 from sliding out of the package. One package employs a catch flap at both ends of the outer package, and the blister card also has an interference blister at either end. That allows the user to pull the blister card out of the package form either end. The embodiment in FIG. 19 shows an outer package blank 215 formed from a single sheet of material. Scores for folding create a front panel 219, a back panel 221, two side panels 223, a glue panel 225, two end panels 227, one of which is glued to the other, and a catch flap 217 to form the finished shape. The catch flap 217 may have an opening 229. Folds, creases, or scores in the material separate each panel.

The catch flap 217 is attached to the front panel 219 or back panel 221 at the open end of the package and folded such that it extends inside the package. The catch flap 217 is long enough to ride on top of the product hold blisters in card openings 211 without getting caught on any of them, yet still abuts or falls into the interference blisters in openings 213. This prevents the user from separating the blister card 201 from the outer package, increasing the likelihood that the product information printed on the package stays with the product. The catch flap 217 can also be made such that it lies flat under the blister card 201, coinciding with the layered side of the blister card 201. With the flap 217 in this orientation, the interference blister in opening 213 is formed so that the catch flap 217 extends up into the cavity of the blister.

Figure 20:
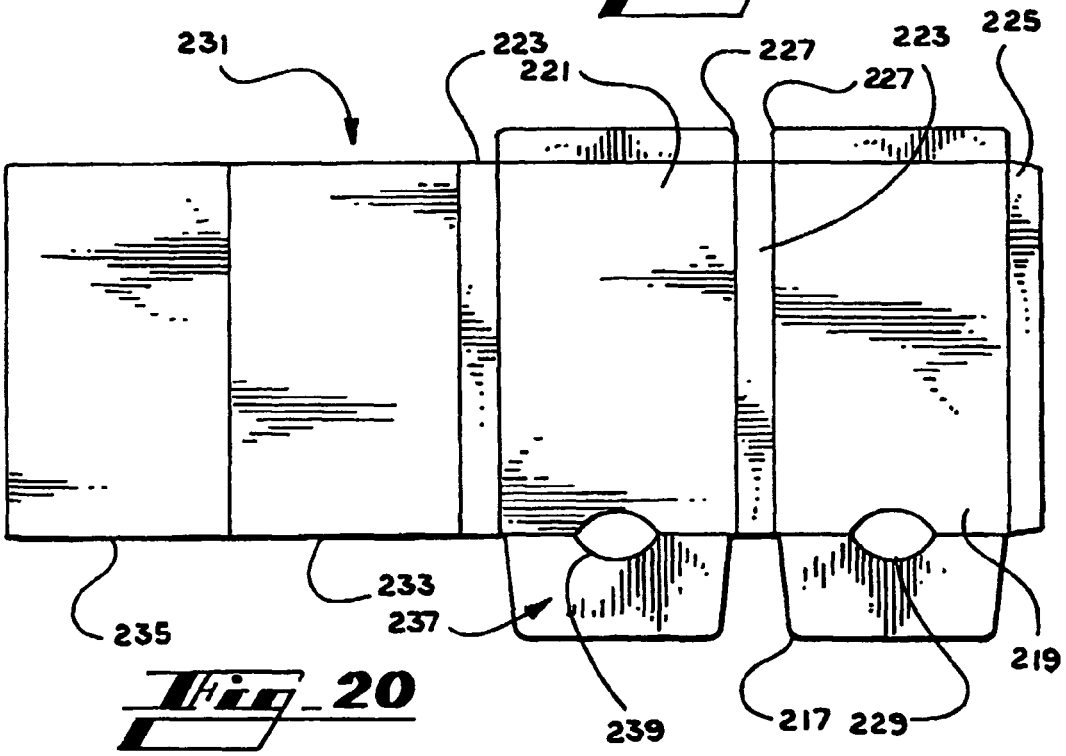
FIG. 20 is an illustration of a blank for forming a base package with additional panels for information as well as aesthetics.

FIG. 20 is an illustration of a blank 231 for forming an outer package with additional panels 233, 235 for information as well as aesthetics. The blank 231 is similar to that of FIG. 19. Additional panels/features can be extended from available raw edges or surfaces to create closure flaps, informational literature pockets, visual design features and other similar forms. A panel 237 is added to the open edge of the outer package opening end for aesthetic reasons. The aesthetic panel 237 extends from the front panel 219 or back panel 221 and is folded 180-degrees, unprinted side-to-unprinted side, and adhered to the inside of front panel 219 or back panel 221. This configuration effectively hides a raw edge, giving a more pleasing and finished look to the package. The aesthetic panel 237 may also have an opening 239. Unlike FIG. 19, two additional panels 233, 235 are attached to the glue panel 225 for holding information.

Figure 21:
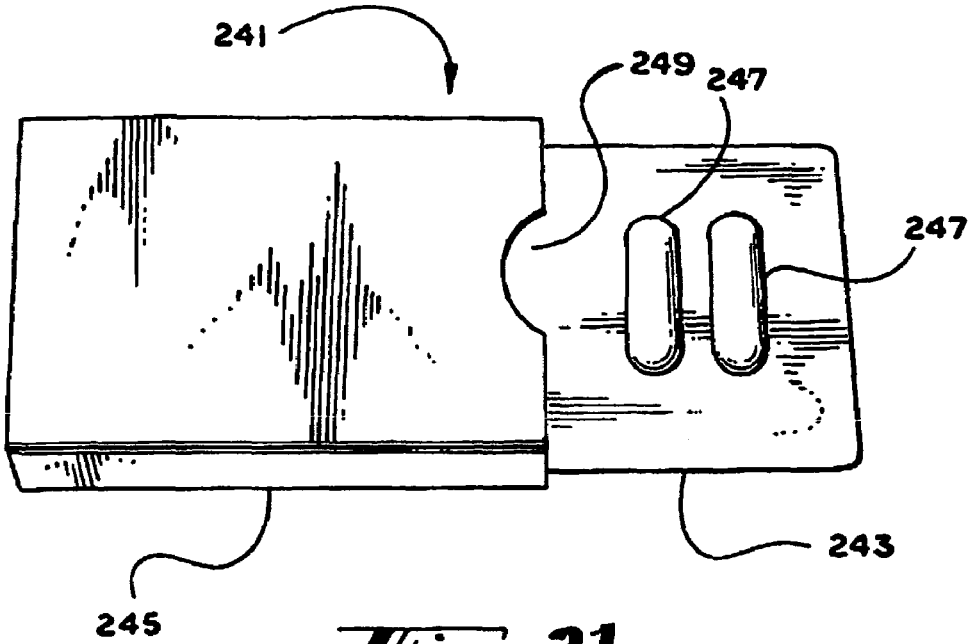
FIG. 21 a view of a finished package with blisters partially removed from the package.
Figure 22:
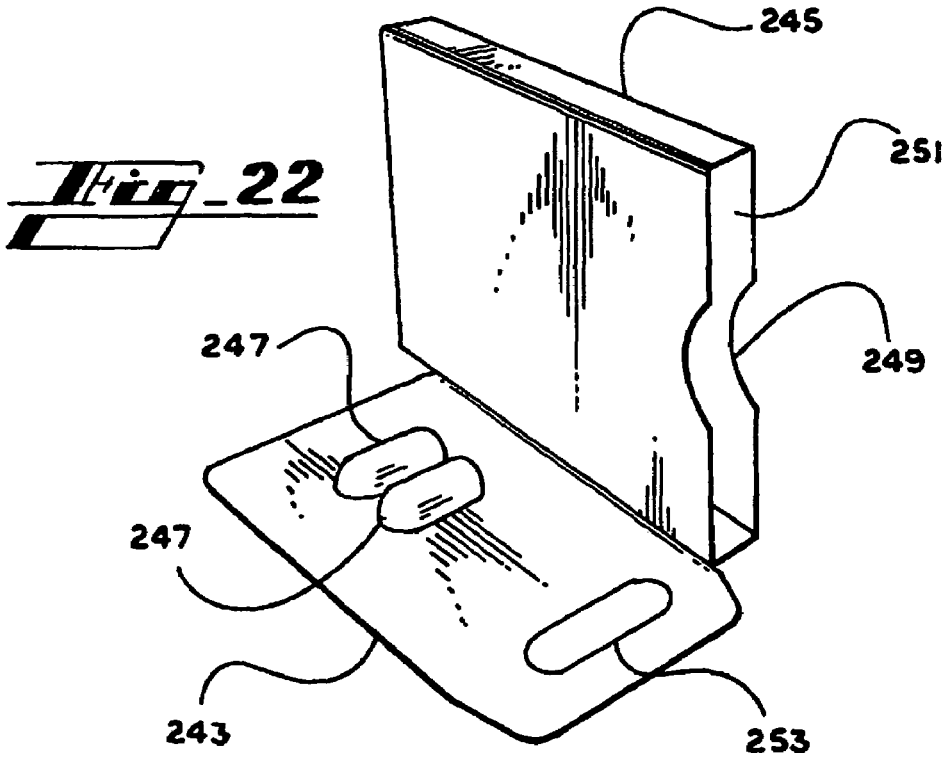
FIG. 22 shows a package and blister card side by side.
Figure 23:
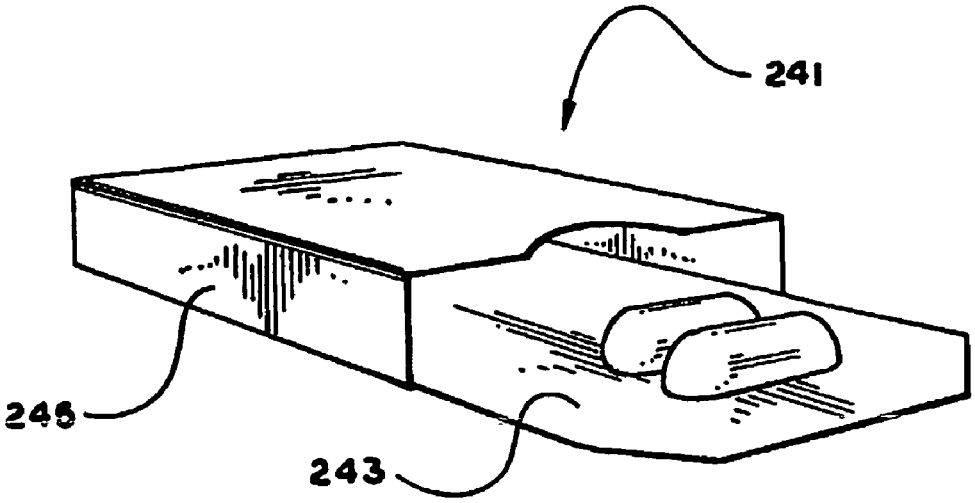
FIG. 23 shows a perspective view of a combined blister card and package.
Figure 24:
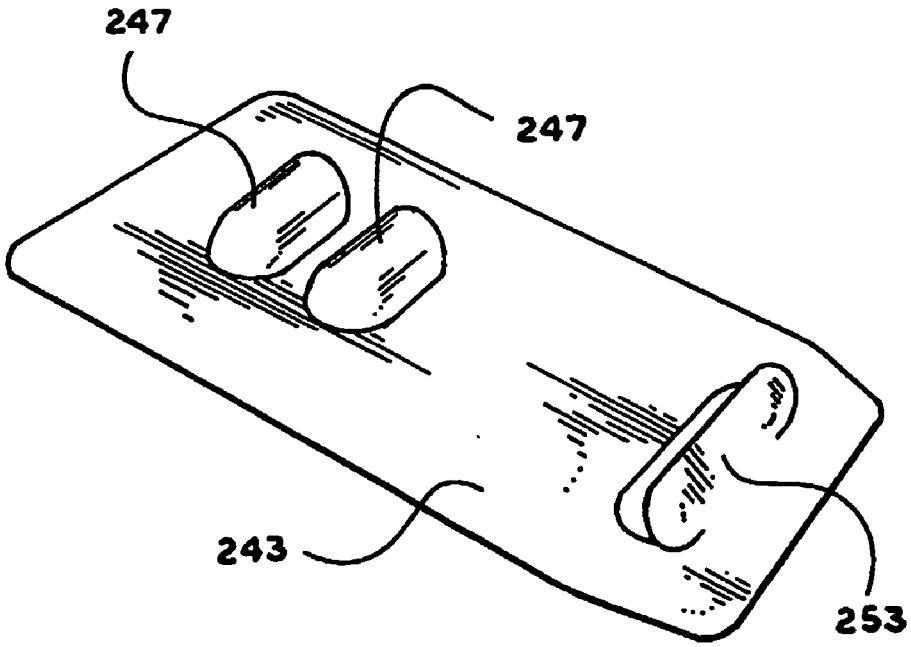
FIG. 24 shows an assembled blister.

FIG. 21 a view of a finished container 241 with a blister card 243 partially removed from the outer package 245. Blisters 247 hold products or other materials. The openings 229, 239 in the outer package blanks become thumb holds 249 when the outer package 245 is glued and folded. FIG. 22 shows an outer package 245 and blister card 243 side by side, with the end opening 251 in the outer package that receives the blister card 243. An interference mechanism 253 is also shown. FIG. 23 is a perspective view of a combined blister card and package 241. FIG. 24 shows an assembled blister card 243 with the interference mechanism 253, which may be a slotted and raised part of the card.

The loaded blister card 243 slides into or is placed inside of the outer package 245. Both the blister card 243 and outer package 245 have cooperating interference mechanisms that prevent the blister card 243 from being separated from the outer package 245. The interaction of the outer card structure 245 with the structure of the blister card 243 is novel and unique, with or without the child resistant locking feature.

While the invention has been described with reference to specific embodiments, modifications and variations of the invention may be constructed without departing from the scope of the invention.

The invention claimed is:

1. A packaging apparatus comprising:

a card and an outer package for receiving the card, the card comprising a plurality of blisters, and the outer package having an open end and an opposed sealed end, the outer package comprising first and second flaps each having a free end configured to extend into the outer package to engage at least one of the blisters, wherein the first flap is hingedly connected to the open end of the outer package along a first fold and extends toward the second flap, and the second flap is hingedly connected to the outer package along a second fold that is separate and spaced from the first fold, the second flap extending toward the sealed end.

2. The packaging apparatus of claim 1, wherein the card is connected to the outer package for sliding movement between a fully inserted position and an outwardly extended position, the blisters include at least one interference blister that is disposed closer to the sealed end than the other blisters, the first flap is held above the other blisters when the card is not in the outwardly extended position.

3. The apparatus of claim 2, wherein the at least one interference blister is hollow and holds no product.

4. The packaging apparatus of claim 2, wherein the card has a blank space where there is no blister, the blank space being defined between the at least one interference blister and the other blasters.

5. The packaging apparatus of claim 4, wherein the first flap is disposed at the blank space to prevent complete separation of the card and the outer package when the card is in the outwardly extended position.

6. The packaging apparatus of claim 4, wherein the second flap is disposed at the blank space to hold the card inside the outer packager when the card is in the fully inserted position.

7. The packaging apparatus of claim 2, wherein the other blisters are disposed at a spacing, and the first flap has a length that is greater than the spacing.

8. The packaging apparatus of claim 2, wherein the outer package comprises a plurality of panels, one of the panels being disposed over the blisters when the card is in the fully inserted position, each of the first and second flaps is hingedly connected to the one of the panels.

9. The packaging apparatus of claim 8, wherein the each of the first and second flaps is connected to the one of the panels for movement between an engaging position where the free end of the each flap is spaced apart from the one of the panels and a disengaged position where the free end of the each flap is disposed adjacent to the one of the panels.

10. The packaging apparatus of claim 1, wherein the outer package further comprises an adhered panel connected to the outer package, and the second flap is hingedly connected to the adhered panel along a fold.

11. The packaging apparatus of claim 10, wherein the outer package further comprises a lever which is an extension of the second flap, the lever extends from the second flap beyond the fold, and the lever is formed from the adhered panel.

12. The packaging apparatus of claim 1, wherein the second fold is located between the first fold and the sealed end.

13. A blister and package apparatus comprising:

a blister card inserted into an outer package for sliding movement, the blister card having an interference stop associated therewith, the interference stop comprising raised portion of the blister card;

the outer package comprising one or more pieces of sheet material folded for creating an enclosure for holding the blister card, the outer package having a sealed end and an opposed open end, and a locking flap hingedly connected to the outer package along a fold line that is disposed at a distance from each of the sealed and open ends of the outer package, wherein the interference stop and the locking flap together comprise a locking mechanism for holding the blister card inside the outer package.

14. The blister and package apparatus of claim 13, wherein the fold line is disposed between the sealed and open ends of the outer package.

15. The blister and package apparatus of claim 13, wherein the outer package comprises primary panels, one of the primary panels is disposed over the interference stop to cover the raised portion of the blister card.

16. The blister and package apparatus of claim 15, wherein outer package further comprises an adhered panel adhered to an inside surface of the one of the primary panels, the locking flap is hingedly connected to the adhered panel along the fold line.

17. A blister and package system comprising:

an outer package including opposed front and back panels and having a sealed end and an opposed open end, a blister card inserted into the outer package for sliding movement, the blister card having blisters that are entirely covered by one of the front and back panels when the blister card is fully inserted into the outer package, a locking mechanism for holding the blister card inside the outer package, the locking mechanism comprising a locking flap connected to the outer package along a fold and at least one of the blisters configured to engage the locking flap, wherein the locking flap is disposed between the front and back panels, and the fold of the locking flap is disposed at a position spaced from each of the open and sealed ends of the outer package.

18. The blister and package system of claim 17, wherein the outer package further includes an adhered panel connected to the outer package, and the locking flap is hingedly connected to the adhered panel along the fold.

19. The blister and package system of claim 18, wherein the outer package further includes a lever which is an extension of the locking flap, the lever extends from the locking flap beyond the fold, and the lever is formed from the adhered panel.

20. The blister and package system of claim 18, wherein the outer package further includes an internal panel that is secured to the one of the front and back panels, and the adhered panel is secured to the internal panel.

* * * * *